US005896913A

United States Patent [19]

Grandi

[11] Patent Number: 5,896,913

[45] Date of Patent: Apr. 27, 1999

[54] INVESTMENT CASTING PAPER LINER AND GUARD

[75] Inventor: Daniel B. Grandi, Cranston, R.I.

[73] Assignee: Protech Marketing, Inc., Wilmington, Del.

[21] Appl. No.: 08/959,359

[22] Filed: Oct. 28, 1997

[51] Int. Cl.[6] ..... B22C 13/08; B22C 21/01; B22D 18/06

[52] U.S. Cl. ..... 164/165; 164/361; 164/255; 164/374; 164/376

[58] Field of Search ..... 164/165, 361, 164/255, 35, 376, 374

[56] References Cited

U.S. PATENT DOCUMENTS

| | | | |
|---|---|---|---|
| 1,119,373 | 12/1914 | Stealy | 164/376 |
| 3,443,627 | 5/1969 | Watts | 164/244 |
| 3,520,349 | 7/1970 | Watts | 164/34 |
| 4,825,934 | 5/1989 | Kai | 164/361 |
| 4,915,155 | 4/1990 | Martin | 164/255 |
| 5,257,658 | 11/1993 | Perera | 164/255 |

*Primary Examiner*—Robert Davis
*Assistant Examiner*—L-H. Lin
*Attorney, Agent, or Firm*—Salter & Michaelson

[57] ABSTRACT

A paper receptacle is disclosed designed to improve the investment casting process in vacuum machines. The paper acts as both a vacuum liner and splash guard. It is fabricated as a perforated paper sheet having hooks, which is inserted in a cylindrical manner into casting flasks in order to provide a liner for congealing islands of solid investment plaster onto the surface of the casting flask resulting from the plaster slurry entering the holes; and a splash guard for investment slurry. After burnout, the liner facilitates the production of high-density metal porosity free castings at lower temperatures and in less time and with easy break away of investment plaster from the flask. The splash guard feature eliminates congealed slurry cleanup and prevents vacuum slurry boilover. The space saving resulting from this prevention enables more wax modules to be inserted into flasks increasing production.

5 Claims, 2 Drawing Sheets

INVESTMENT CASTING PAPER LINER AND GUARD

BACKGROUND OF THE INVENTION

This invention relates to the investment casting process also known as the lost wax process. More particularly, the present invention relates to the employment of a paper receptacle to facilitate said process by functioning as both a vacuum enhancement liner and splash guard. The primary application of the instant invention is to facilitate said process in vacuum investment casting machines and investing machines in contradistinction to other types of utilitarian machines utilized in said casting, such as centrifugal or sand casting. Accordingly, any liners or guards used to facilitate investment casting by means other than vacuum casting machines have no bearing on the design of the instant invention.

The instant invention employs a single piece of fabricated paper of special design which serves as both a vacuum liner and splash guard in the investment casting flasks utilized in the vacuum casting machines. As a liner; the instant invention results in better castings due to a strong draw on the metal being cast into the flask and lower casting temperatures that has theretofore been possible; as well as a reduction in casting processing time. As a splash guard; the instant invention prevents the accumulation of investment slurry on metal flask surfaces and on the investing machine resulting in decreased cleanup costs, eliminating associate time losses resulting in cleanup, as well as enabling more lost wax modules to be placed in the same attendant space than has been heretofore allowed.

Now the use of paper to facilitate investment casting is not new. U.S. Pat. No. 1,119,373; issued Dec. 1, 1914, by Elza Stealy describes using a round disk of paper in the investment process which is consumed. U.S. Pat. Nos. 3,443,627 and 3,520,349 awarded to Claude H. Watts respectively, in 1969 and 1970, describes the construction of cardboard sprues to attach modules of wax to aid investment casting. This is not a vacuum liner or splash guard, nor is it utilized in vacuum investment casting. Subsequently, Kai was awarded U.S. Pat. No. 4,825,934 of May 2, 1989. It describes a paper cushioning sheet for exclusive use in denture casting to prevent special dental investment from cracking. While said sheet's appearance is similar in some respects to the instant invention, its function is not claimed to facilitate vacuum casting; and will not work in a vacuum casting machine.

OBJECTS OF THE INVENTION

The main object of the invention is to provide in a single piece of paper the dual capabilities of a vacuum liner and splash guard to assist the investment casting process when performed by vacuum casting machines and investing machines.

Another object of the invention is to increase the vacuum drawing capabilities of the vacuum investment casting process.

Still another object of the invention is to improve the quality of castings obtained by said process as a result of achieving the previous object of the invention, yielding castings with both high density and low or no porosity.

Still another object of the invention is to lower the metal flask temperature in said casting process, due to better vacuum draw.

Still another object of the invention is to reduce the production time of said casting process.

Still another object of the invention is to decrease the cost of cleanup of solidified investment slurry from said investment flasks and machines.

Still another object of the invention is to prevent vacuum boilover of investment slurry in said investing process.

Still another object of said invention resulting from achieving the previous object allowing more space in the casting flask is to enable the placing of more wax module units in the same flask increasing the productive capabilities of said flask.

Still another object of the invention is to facilitate removal of congealed investment from the flask without force preventing distortion.

Other objects and features of the present invention will become apparent to those skilled in the art when the present invention is considered in view of the accompanying description of the preferred embodiment. It should, of course, be recognized that the accompanying detailed description of the preferred embodiment is not intended as a means of defining the limits and scope of the present invention but is rather illustrative.

SUMMARY OF THE INVENTION

In accordance with the present invention, there is provided in a single piece of perforated paperboard, both vacuum enhancement lining and splash guard capabilities for utilization in flasks employed in vacuum machines utilized in the investment casting process. Said paperboard liner will serve as a barrier between the investment plaster and the metal flask. Said paperboard single sheet is designed in such a manner as to protrude two to three inches above the level of the steel flasks. The single sheet is taken and rolled inside the flask so that both ends of the single sheet meet to form the outline of a cylinder within the flask.

The wax modules are centered into the casting flask. Investment slurry is then poured into the flask and air bubbles removed by vacuum. Since the liner acts as a splash guard protruding above the flask, more wax modules can be introduced into the flask than is conventionally possible. Accordingly, slurry boilover is prevented from occurring due to the efficacy of the paper liner splash guard which prevents the plaster slurry from leaving the metal flask since it extends at least two to three inches above the flask. Once the investment plaster slurry has set to a solid, the flask is introduced into a furnace to burnout the wax. The next operation comprises introducing the flask with the burned-out cavities prepared to accept molten metal into the vacuum casting machine. The burnout process will have vaporized the paper liner leaving a cavity surrounding the fired investment. However, there will be islands of contact with the sides of the flask caused by solidified investment which in its slurried state, had entered through the perforated cavities of the paper liner. The molten metal is finally introduced into the investment via the vacuum casting machine. The net result of the lost paper liner of this phase of the casting process will be that the vacuum source is closer to the item being cast than is the conventional case. Therefore, molten metal will be drawn into the cavity more easily and at a lower temperature resulting in higher quality castings as manifested by higher density metal castings and reduced or entirely eliminated porosity in the casting. The burnt-out liner cavity also facilitates investment removal upon quenching, eliminating the need to apply force to the investment which often results in distorted castings.

Other features and objects of the present invention will become apparent from the following description taken with reference to the accompanying drawings.

DETAILED DESCRIPTION OF THE PREFERRED EMBODIMENT

Figure 1:
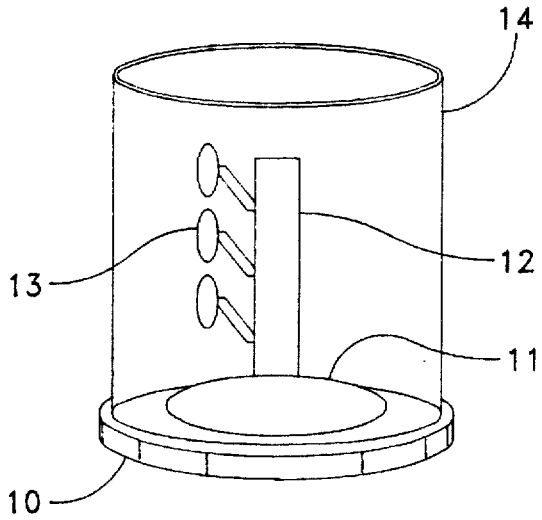
FIG. 1 is a perspective view of a stainless steel casting flask inserted into the rubber base but covering the sprue and wax modules to be cast.
Figure 2:
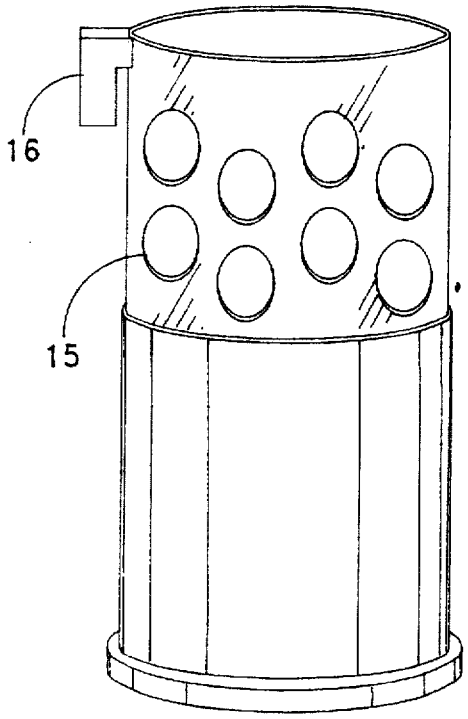
FIG. 2 is a side view of the perforated paper liner splash guard.
Figure 3:
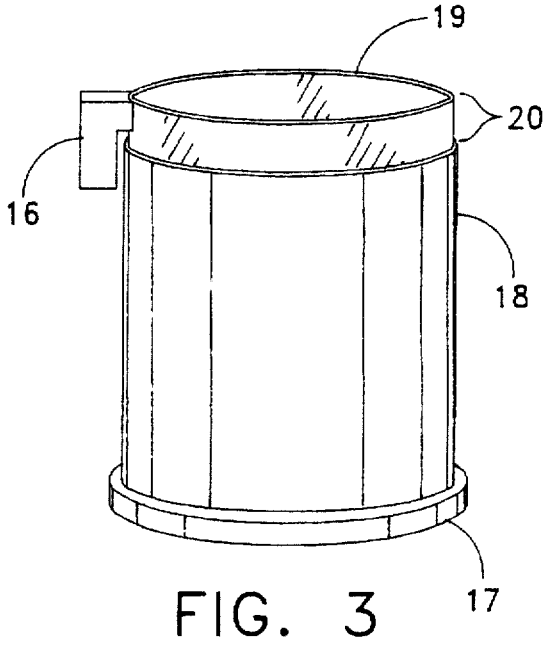
FIG. 3 is an explanatory view of the paper vacuum liner splash guard inserted into the investment casting flask.
Figure 4:
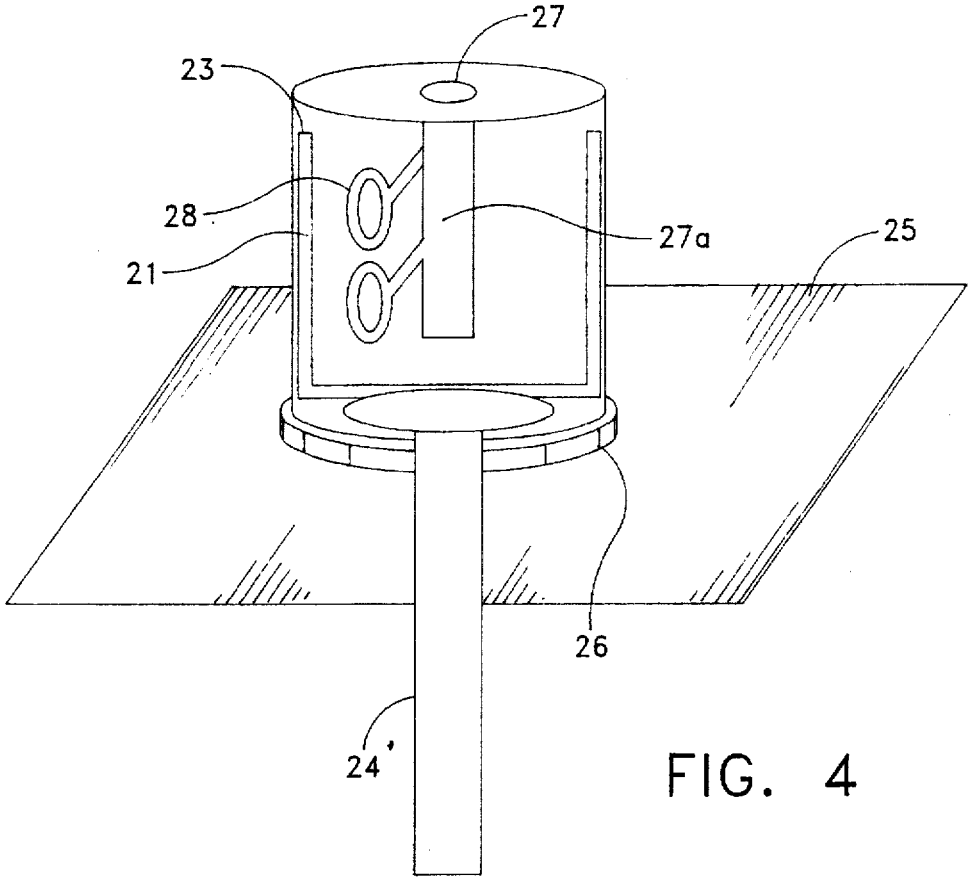
FIG. 4 is an explanatory view of the investment casting flask after burnout of the liner-splash guard.

Referring now to the drawing, FIG. 1 depicting the casting flask and its contents; 10 is the rubber base to which is attached sprue holder 11 which holds sprue 12 upon which wax modules 13 are mounted. All of the aforementioned are covered by flask 14 which fits snugly into the rubber base 10. Turning now to the drawing, FIG. 2 showing the paper product liner to be inserted by hand or with special tools into the flask; round holes 15 in the paper are where investment plaster slurry will flow which will solidify and bond to the metal flask. Hooks 16 on top of the paper are there to locate the paper in the flask, after which it is overlapped to prevent the paper from slipping into the flask cavity more than is necessary; as the bottom part of the liner must stop approximately ¾ inches from the bottom of the flask, or the vacuum will not properly function. Thus, the insertion of the paper liner is depicted in FIG. 3 where the rubber base 17 accommodates flask 18, and the paper liner splash guard 19 protrudes out of the flask a measured distance 20, preventing slurry vacuum boil and subsequent hardened investment cleanup. When the investment plaster in the casting flask has hardened sufficiently, the rubber base 17 will be removed, and the excess paper 20 at the top of the flask can be torn off to facilitate the stacking of flasks 18 in the burnout oven. All of the sprue wax and combustible components including the paper flask liner will be burned-off. Turning now to FIG. 4 which depicts the casting flask after burnout; the casting flask is turned upside-down onto a high temperature rubber pad 26, on top of steel plate 25 through whose center is a tube 24 connected to a vacuum. This configuration is the basic vacuum machine. Molten metal is poured into burned-out sprue holder cavity 27 which flows through lost wax sprue cavity **27*a* into lost wax module cavities 28. The flow is facilitated by burned-away vacuum liner 22's cavity 21 as well as space 23 where the investment plaster stops in order to create a vacuum area that connects to cavity 21 of burned-away liner 22**. After metal has been poured and the caster has waited a sufficient time for the metal to solidify, the flask is quenched in water to remove the investment plaster from the cast metal parts and the flask. The flask liner results in dense castings with either no or low porosity as well as lower casting temperatures and reduced time for casting as well as increased module number processing capability. Furthermore, since the liner has reduced the total contact area of plaster to flask wall; plaster easily shatters upon quenching eliminating the necessity of mechanically breaking investment which often leads to distorted castings.

What is claimed is:

1. A cylindrical investment casting flask having top and bottom circular edges, a perforated paper liner snugly positioned within said flask, said liner having a bottom end located above said flask bottom edge, whereby the perforations in said liner permit communication between said flask and investment material located within said liner, and the space between said liner bottom end and said flask lower edge permits communication between the investment material and the flask at said space, whereby when said liner is burned away, an annular vacuum chamber is provided in the area formerly occupied by said liner.

2. The combination of claim 1 wherein the height of said space is approximately ¾ of an inch.

3. The combination of claim 1 further characterized in that said liner has an upper portion that extends above said flask top edge, said liner upper portion functioning to prevent investment boilover.

4. The combination of claim 3 further characterized in that said liner upper portion has hook means that sit on said flask top edge to maintain said liner in proper assembled relation with said flask.

5. The combination of claim 4 wherein said hook means are an integral part of said liner.

* * * * *